United States Patent [19]

Stokes

[11] Patent Number: 5,057,824

[45] Date of Patent: Oct. 15, 1991

[54] ELECTRONIC APPARATUS WITH ON-SWITCH TO CONSERVE BATTERY BEFORE CLOSING SWITCH

[75] Inventor: John H. Stokes, Lincoln, Nebr.

[73] Assignee: Wanderguard, Inc., Lincoln, Nebr.

[21] Appl. No.: 559,642

[22] Filed: Jul. 30, 1990

[51] Int. Cl.[5] ..... H01H 27/04

[52] U.S. Cl. ..... 340/693; 200/61.19; 361/380; 341/176

[58] Field of Search ..... 340/693; 200/61.19; 455/100, 128; 361/380; 341/176

[56] References Cited

U.S. PATENT DOCUMENTS 4,491,970 1/1985 LaWhite et al. ..... 455/128
4,617,561 10/1986 Brown ..... 200/61.19
4,952,913 8/1990 Pauley et al. ..... 455/100

*Primary Examiner*—Glen R. Swann, III

*Attorney, Agent, or Firm*—Vincent L. Carney

[57] ABSTRACT

To provide a novel electrical personnel security system in which a battery is open circuited until ready for use and then energized while permitting a casing to remain sealed; a case for a transmitter supports a circuit board having a battery opening in it. The battery is supported within this opening by positive and negative battery contacts which are conductive springs that hold the battery between them and exert force against them. One of the battery contacts is in direct electrical contact with the battery while the other is separated by a spacer member aligned with a guideway to prevent closing of the circuit as long as the spacer member is in place between the contact and the battery. The casing includes an aperture for the insertion of a pin that results in removing the spacer by moving it along the guideway without tilting the circuit board. The aperture may be sealed by a plug against water.

5 Claims, 2 Drawing Sheets

ELECTRONIC APPARATUS WITH ON-SWITCH TO CONSERVE BATTERY BEFORE CLOSING SWITCH

BACKGROUND OF THE INVENTION

This invention relates to circuits for preventing the discharge of a battery in a circuit prior to its intentional activation, such as for example, a portable radio circuit which may be stored with the battery disconnected and then energized just prior to use.

Portable transmitters are known which are sealed and contain a battery. To preserve the battery, it is disconnected until ready for use and then connected, at which time it energizes the radio circuit. One such system is disclosed in John R. Shirley U.S. Pat. No. 4,682,155 entitled PERSONNEL SECURITY SYSTEM, directed to a system for monitoring the passage of certain persons through a door. This system detects the opening of a door by a radio transmitter that is worn by the person monitored on a wrist band. This unit is shipped to the site and just before being placed on the person to be monitored, the battery is activated.

In the prior art battery conservation device, a capacitor in the radio circuit is shorted by a conductor to prevent an electronic switch from being biased to conduction. The switch is in circuit with a battery so that the battery remains disconnected until the switch, which in the prior art circuit is a transistor, is biased forwardly for conduction by opening the conductor which shorts the capacitor. Upon opening this conductor, the transmitter is biased to begin operating the transmitter.

To permit the capacitor to be shorted and the short circuit opened at will, a conductor is connected across the capacitor and extends outside a sealed casing for the unit. To remove the short circuit across the capacitor, the wires are cut thus leaving the seal in place around the transmitter but opening the capacitor so that it biases the transistor into its conducting region.

The prior art battery conservation circuit has some disadvantages, such as for example: (1) permitting some power drain when the capacitor is shorted; and (2) under some circumstances, of interfering with the operation of the transmitter. For example, the two ends of the conductors that have been cut to cause the transmitter to operate may be shorted by perspiration or by contact with a conductive surface. Under this circumstance, the transmitter will stop operating.

SUMMARY OF THE INVENTION

Accordingly, it is an object of the invention to provide a novel circuit for permitting a battery to be in an open circuit during storage and energizing it while permitting the casing of the circuit to be watertight in use.

It is a further object of the invention to provide a novel technique for conserving batteries that are connected in certain circuits.

It is a further object of the invention to provide a novel radio trigger designed to have a convenient battery activation circuit within it.

It is a still further object of the invention to provide a novel personnel security system in which the battery is open circuited until ready for use and then energized while permitting the casing to remain sealed.

In accordance with the above and further objects of the invention, a case for a transmitter supports a circuit board having a battery opening in it. A battery is supported within this opening by positive and negative battery contacts that are conductive springs that hold the battery between them and exert force against them. One of the battery contacts is in direct electrical contact with the battery while the other is separated by a spacer member aligned with a guideway to prevent closing of the circuit as long as the spacer member is in place between the contact and the battery.

The casing includes an aperature which provides for the insertion of a pin that results in removing the spacer by moving it along the guideway without tilting the circuit board. The aperature may be further sealed by inserting a second plug against water. To prevent misalignment by tilting of the board or by angular motion of the guide, the casing has a guideway formed in it and a contact spacer mounted to the guideway. A guide member is designed to be guided by the guide surface in the casing and includes a spacer arm containing a portion which may be moved from its location between the contact in the battery to cause the circuit to close. With this arrangement, using close tolerances in the parts, alignment is preserved and the circuit may be closed to energize the transmitter with minimum tilting of the circuit board or of the spacer.

In operation, the transmitter is part of a wrist band placed on personnel to be monitored and connected with the intention that it remain permanently connected. Immediately before placing the band on the patient, a pin is inserted through a specified location in the casing. The pin moves a predetermined distance against a relatively large force surface of the spacer. The spacer is moved along a guideway with minimum tilting, thus moving a spacer arm a short distance from a fixed edge to permit the spring to drop downwardly against the battery and energize the circuit.

To permit sufficient precision to avoid misalignment, a group of circuit boards are made from precision materials and then cut by a laser to accurate dimensions to prepare a series of boards and the holes are drilled with a tolerance of plus or minus 0.007 of an inch . Of particular significance is the battery location on the board which fixes the battery and with respect to the guideway molded into the casing and to a guiding aperture which receives the plunger and inserts it through the casing.

To permit soldering of electrical components, the leaf springs are placed in apertures in the board and a dummy battery located between them. A continuous soldering method is then used to solder the components and the battery springs in place prior to assembling into the casing.

As can be understood from the above description, the battery protection circuit of this invention has several advantages such as: (1) it is inexpensive; (2) it is not subject to shorting out during use of the transmitter; and (3) it may be maintained in a water tight casing.

SUMMARY OF THE DRAWINGS

The above-noted and other features of the invention will be better understood from the following detailed description when considered with reference to the accompanying drawings in which.

DETAILED DESCRIPTION

Figure 1:
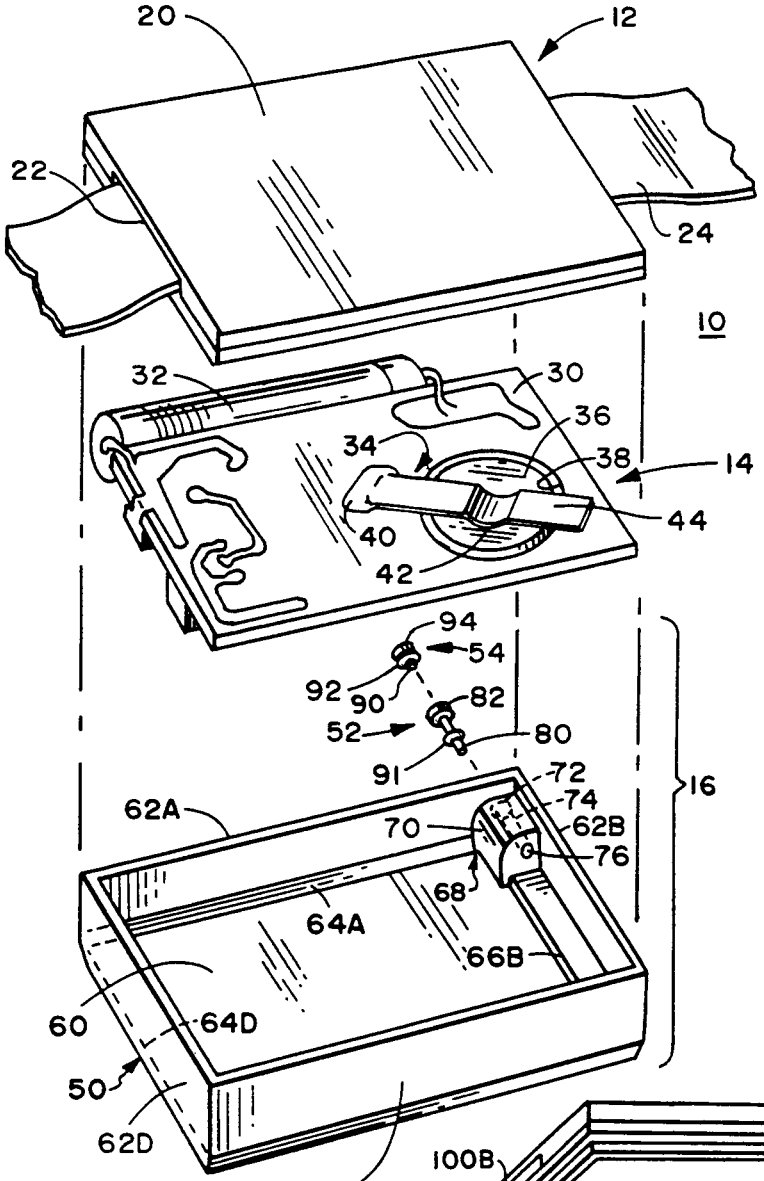
FIG. 1 is an exploded perspective view of an embodiment of radio transmitter that includes a battery power conservation circuit in accordance with the invention.

In FIG. 1, there is shown an exploded perspective view of a wrist transmitter 10 having a cover assembly 12, a circuit board assembly 14, and a case assembly 16. The circuit board assembly 14 fits within the case assembly 16 and is adapted to be closed by the cover assembly 12. The cover assembly 12 also is adapted for mounting to a patient such as by a wrist band.

The wrist transmitter 10 is substantially the same as that described in U.S. Pat. No. 4,682,155 except that it incorporates a novel method for conserving the energy stored in a battery. For purposes of general description, the disclosure of U.S. Pat. No. 4,682,155 is incorporated herein by reference.

To seal the case assembly 16 against moisture with the circuit board assembly 14 inside and to permit fastening to a patient, the cover assembly 12 includes a cover plate 20, a slot 22 and a wrist strap 24. The cover plate 20 is adapted to fit within the rim of the case assembly 16 and be sealed thereagainst. The slot 22 runs across the case and is of sufficient size to support a wrist band 24 which may be fastened onto a patient by the staff of a nursing facility or other care facility.

The circuit board assembly 14 includes a circuit substantially the same as that described in aforementioned U.S. Pat. No. 4,682,155 but also has certain elements related to conserving battery energy not shown in that patent. As shown in the view of FIG. 1, the circuit board assembly 14 includes a circuit board 30, an inductor 32, a negative battery contact 34, a battery 36 and a battery opening 38. The battery 36 fits within and rests against the circuit board 30, extending outwardly against the negative battery contact 34 which is mounted to provide electrical contact through the battery. The inductor 32 is part of the aforementioned circuit and is mounted separately to the board.

To make electrical contact, the negative battery contact 34 is an elongated metal strip including a fastening section 40, a battery contact section 42, and an end section 44. The battery contact section 42 is centered and has on one end the fastening section 40 and at the other end the end section 44, which sections are integrally formed into the elongated metal strip.

To ground the negative battery contact 34, the fastening section 40 is inserted into and soldered to the circuit board 30 at one end of the elongated metal strip which extends directly across the battery opening 38. The battery contact section 42 is arcuate and extends downwardly to exert pressure against the center of the battery 36 and thus establish electrical contact with a negative terminal. The negative battery contact 34 is adjusted in cooperation with the rim of the battery opening 38 to provide 2.5 ounces of pressure in normal use. The rim of the battery opening 38 engages a shoulder of the battery 36, permitting it to extend a fixed distance beyond the board where it engages the battery contact section 42 to serve as a good electrical contact.

The case assembly 16 includes a case 50, a pin or plunger 52 and a plug 54, with the pin 52 and plug 54 being auxillary and used at different times with the case 50. The case 50 holds the circuit board assembly 14 in a fixed position such that it is not subject to being tilted and is aligned with an opening that receives the pin 52 and plug 54 at different times. The pin 52 is used to activate the battery 36 in the circuit board assembly 14 when the transmitter is about to be used. Prior to that time, the pin 52 is partly extended from the case 50 and cooperates with an "O" ring 91 to seal the case 50. After activation, the plug 54 and its associated "O" ring 92 aids in sealing the case 50.

The case 50 includes a bottom wall 60, four side walls 62A–62D, three angled bottom portions 64A, 64C and 64D (64C not being shown in FIG. 1), a guide ledge 66B and a pin-plug receiving section 68. The walls are sufficiently high and spaced from each other sufficiently far to receive the circuit board 30 and provide a watertight closure when the cover assembly 12 is placed thereon. The principal components (not shown in FIG. 1) fit against the bottom with the negative battery contact 34 being above the board and pressing against the battery 36.

The angled bottom portions 64A, 64C and 64D connect the bottom wall 60 to the side walls 62A, 62C and 62D respectively and aid in providing spacing so that the board fits evenly and is not positioned with a portion of it extending over the guide ledge 66B which connects the bottom wall 60 to the side wall 62B. The pin-plug receiving section 68 is integrally formed with the guide ledge 66B at one location and connects at that location to both the side wall 62A and the side wall 62B to receive and provide guidance to the pin 52.

To guide the pin 52 in closing the battery circuit to initiate transmitting, the pin-plug receiving section 68 includes a boss 70, an aperture 72 and a guide slot or passageway 74. The aperture 72 is initially closed by a partly inserted pin assembly 52 and its associated "O" ring 91. The guide slot 74 extends through the boss 70. With this arrangement, the pin 52 may push inwardly at a level fixed with respect to the guide ledge 66B to put the battery 36 into circuit with the rest of the transmitter. The aperture 72 and guide slot 74 are sized to fit the pin 52 to permit the pin 52 to move a positive contact spacer 102 (not shown in FIG. 1) outwardly parallel to the guide ledge 66B.

To push the positive contact spacer 102 (FIG. 2) and thus put the battery 36 into circuit with the transmitter, the plunger 52 includes a shaft 80 and a head 82. The shaft 80 is cylindrical and has an outer diameter conforming to the inner diameter of the guide slot 74 so that, when the aperture 72 is available, it may be inserted to move the positive contact spacer 102 forwardly.

To further close the aperture 72 after the battery 36 is connected in circuit in a manner that seals against the leakage of water, the plug assembly 54 includes a shaft 90, an O-ring 92, and a head 94 that cooperate with the plunger 52 and its associated "O" ring 91. The shaft 90 is adapted to fit within the guide slot 74 so that the O-ring 92 may be pressed tightly against and into the guide slot 74 until the head 94 completely closes the aperture 72. This plug assembly 54 is used after the plunger 52 is pushed inwardly causing the battery 36 to be in circuit to further seal the opening in guide slot 74 so that the interior of the case 50 remains watertight and is able to function even though a wrist band containing the transmitter is immersed in water.

Figure 2:
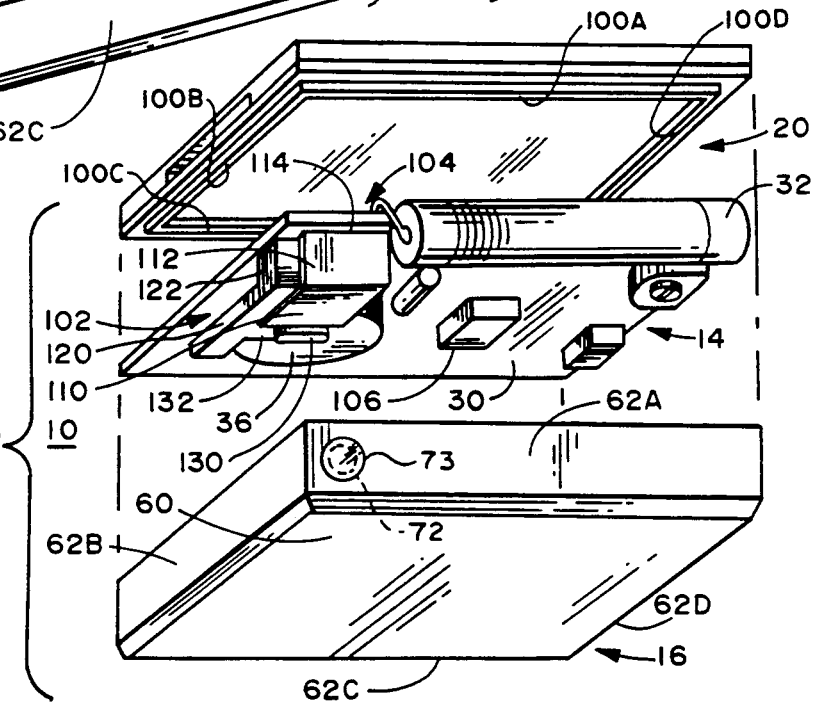
FIG. 2 is an exploded perspective view of the embodiment of FIG. 1 from a different angle.

In FIG. 2, there is shown an exploded perspective view of the wrist transmitter 10 from a lower angle to better illustrate the bottom of the cover plate 20 and the circuit board assembly 14. As best shown in this view, the cover plate 20 includes a downwardly extending square ring formed of lips 100A–100D to fit within the corresponding side walls 62A–62D and seal the cover to the case.

The bottom of the circuit board 14 includes the transmitter circuit elements shown generally at 106, the positive contact spacer 102 and the positive battery contact 104 in position to provide the other clamp for the battery 36 to hold it removably in place between the positive battery contact 104 and the negative battery contact 34 (FIG. 1).

To resiliently apply pressure for electrical contact to the battery 36, the positive battery contact 104 is a resilient conductor such a beryllium copper formed in three parts, which are: (1) a top spring part 110; (2) an angled connecting part 112; and (3) a fastening part (not visible in FIG. 2). The fastening part is soldered to the board 30 and the top spring part 110 and connecting part are at an angle to apply approximately 10 pounds pressure onto the battery 36 for a good electrical contact and firm holding. This pressure pushes the battery 36 downwardly into the opening 38 in the board 30 which is sized in such a manner as to catch a rim of the battery 36 with a small battery portion extending therethrough.

To permit the battery circuit to remain open and be closed just before use, the positive contact spacer 102 includes a guide member 120, a force surface 122 and a spacer arm 124. The force surface 122, guide member 120 and spacer arm 124 are integrally formed with each other and positioned so that the force member may be easily pressed against by the plunger shaft 80 (FIG. 1) as it moves through the passageway 74 (FIG. 1) and thus move the positive contact spacer 102. The spacer arm 124, when the battery 36 is inactivated, contains a positioning ridge 130 and a spacer edge 132 with the positioning ridge 130 fitting against the edge of the top spring part 110 and the spacer lip fitting under and between the bottom of the top spring portion 110 and the battery 36 to prevent a connection from being made.

With this arrangement, as the force surface 122 is moved inwardly by the shaft 80 (FIG. 1) away from the side wall 62A and the boss 70 (FIG. 1), it moves from under the spring so that the spring collapses and makes electrical contact against the battery 36 to close the circuit and institute transmission.

Figure 3:
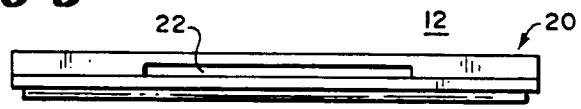
FIG. 3 is an elevational view of a portion of the embodiment of FIGS. 1 and 2.

In FIG. 3, there is shown an elevational view of the cover assembly 12 showing a slot 22 passing through the cover plate 20 for receiving the strap 24 (FIG. 1). The slot 22 extends entirely through the cover plate 20 which is formed by adhering two portions together with a recess leaving the slot.

Figure 4:
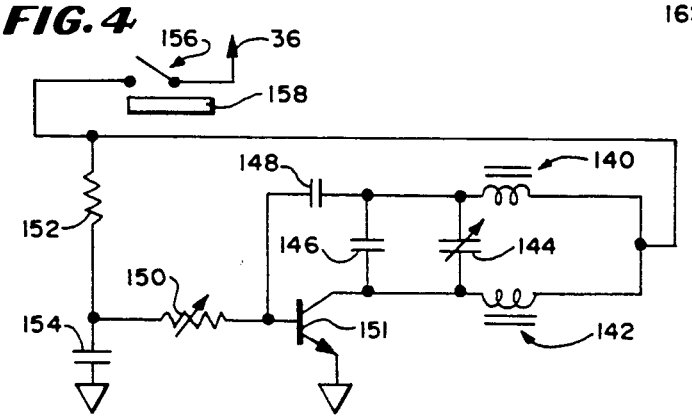
FIG. 4 is a schematic circuit diagram of an embodiment of the invention and an alternative embodiment of the invention.

In FIG. 4, there is shown a schematic circuit diagram of a radio transmitter circuit, substantially the same as that disclosed in the aforementioned U.S. Pat. No. 4,682,155 including inductor parts 140 and 142 forming the inductor 32 (FIGS. 1 and 2), a variable capacitor 144, capacitors 146, 148 and 154, resistor 152 and variable resistor 150 and transistor 151.

Although this circuit is substantially as described in U.S. Pat. No. 4,682,155 and is not itself a part of the invention, two embodiments of a switch are disclosed schematically connected in circuit with it and to the battery 36 and together these illustrate a feature of the invention. In one of the two embodiments, a reed switch 156 may be closed by the insertion of a magnet 158 into the casing adjacent thereto. In the other embodiment, the insertion of the plunger shaft 80 (FIG. 1) opens the switch 156 which consists of the top spring part 110 (FIG. 2) and spacer arm 124 (FIG. 2) of the positive contact spacer 102 (FIG. 2).

Figure 5:
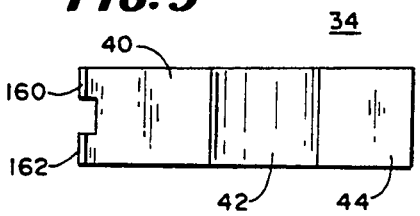
FIG. 5 is a plan view of a portion of the embodiment of FIGS. 1 and 2.
Figure 6:
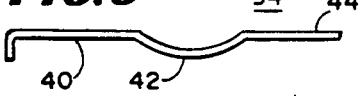
FIG. 6 is a side view of the portion shown in FIG. 5.

In FIGS. 5 and 6, there is shown a plan and elevational view respectively of the negative battery contact 34 with the fastening section 40, battery contact section 42 and end section 44 integrally formed together out of beryllium copper 0.006 inches in thickness. The spring-like conductive material has a width of 0.156 inches and a length of 0.562 inches and is shaped with the fastening system 40 ending in two spaced apart angled connecting feet 160 and 162 extending upwardly from the plane of the flat side of the contact 0.038 inches and each being 0.052 inches long in the direction orthogonal to the longitudinal axis of the spring separated by a space so that they are on the outer ends.

They are sufficiently long and angled to permit the contact to be inserted into the board 30 (FIGS. 1 and 2) and soldered in place to resist upward bending and exert approximately 2.5 ounces of pressure against the battery 36 (FIGS. 1 and 2). A arcuate portion forms the battery contact section 42 and extends downwardly for pressure against the battery 36 (FIGS. 1 and 2) forming an arc having a radius of 0.187 inches at a distance of 0.312 from the fastening end.

While a flat beryllium spring has been disclosed in the preferred embodiment, many other types of electrical contacts could be used such as for example a spring or a thinner wire or the like. The negative battery contact 34 does not serve as a clamp since the battery 36 fits against a rim in the circuit board 30 but it could serve as a clamp in the manner that the positive battery contact 104 (FIG. 2) does in the other side that permits easy insertion or removal of the battery 36 during assembly.

Figure 8:
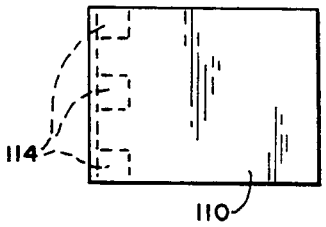
FIG. 8 is a plan view of the portion of FIG. 7.
Figure 7:
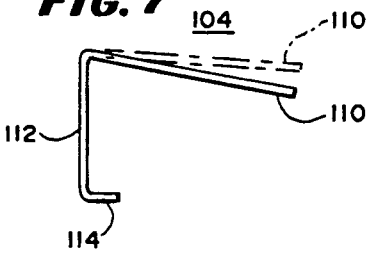
FIG. 7 is a side elevational view of another portion of the embodiment of FIGS. 1 and 2.

In FIGS. 7 and 8, there are shown a side elevational view and a plan respectively of the positive battery contact 104 having the top spring part 110, the angled connection part 112 and the fastening part 114 with the fastening part 114 consisting of three inwardly extending members adapted to hook under the circuit board 30 with the angled connecting part 112 extending upwardly substantially perpendicularly from the board 30 and the top spring part 110 extending downwardly to exert approximately 10 pounds of pressure against the battery 36 (FIGS. 1 and 2) to hold it within the recessed rim of the circuit board 30 (FIGS. 1 and 2).

The entire spring is integrally formed of beryllium copper substantially 0.010 inches in thickness. It is 0.312 inches wide with the top spring part 110 being 0.375 inches long with its distal end extending upwardly from its bottom 0.14 inches and being adapted to move upwardly to receive a battery 0.180 inches. The angled connecting part 112 is 0.234 inches long and fits 0.031 inches beneath the board.

Figure 9:
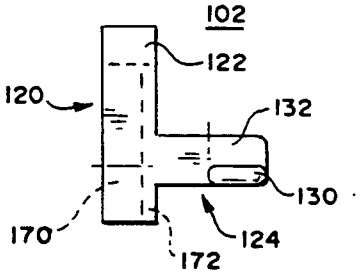
FIG. 9 is a plan view of still another portion of the embodiment of FIGS. 1 and 2.
Figure 10:
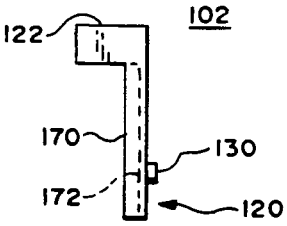
FIG. 10 is a side elevational view of the embodiment of FIG. 9.

In FIGS. 9 and 10, there is shown an enlarged plan view and an enlarged side elevational view respectively of the positive contact spacer 102 more clearly showing the guide member 120, the force surface 122, and the spacer arm 124. As best shown in this view, the force surface 122 is part of a right regular parallelopiped which extends upwardly parallel to the flat outer surface of the boss 70 so that the force surface 122 covers the passageway 74 to receive the extending pin 52 (FIG. 1).

To permit easy alignment and motion, the force surface 122 is 0.187 inches long, 0.093 inches thick and 0.140 inches wide. The guide member 120 has one surface integrally formed with a bottom surface of the parallelopiped including the force surface 122 with a width of 0.140 and intended to fit and move with one edge flat against the side wall 62B and its flat surface resting over the guide ledge 66B (FIG. 1) to be movable smoothly back when the shaft 80 (FIG. 1) passes through the passageway 74 with its bottom surface moving along the top surface of the guide ledge 66B and the spacer arm 124 extending at right angles therefrom.

The spacer arm 124 includes the upwardly extending member or ridge 130 which rests against the bottom wall 60 of the case 50 and elevates the spacer edge or lip 132 from the bottom wall 60 to a height that enables it to fit between the battery 36 and the top spring part 110 (FIGS. 2 and 7) with one edge of the top spring part 110 abutting an edge of the ridge 130 to provide spacing of the spring when the battery circuit is opened and permit closing of the spring against the battery surface when the force surface 122 is pushed away by the plunger shaft 80 (FIG. 1).

For better alignment as the positive contact spacer 102 is moved along the guide ledge 66B, the guide member 120 includes a lower flat member 172 having a height of 0.025 inches and an edge that is adjacent to the top spring member 110 as the spacer arm 124 moves back. A raised ledge 170 has a straight edge that fits against the wall 62B for stabilizing action during that movement and has a height of 0.062 inches from the flat bottom surface and the top surface of the guide ledge 66B. The height of the spacer lip 132 is the same as the height of the portion of the ridge 130 to provide a surface of the spacer lip that is at the same elevation as the lower flat member 172 but which has a bottom edge that rests along the guide ledge 66B to provide further stability to the lip 132. The ridge 130 extends upwardly from the bottom of the lip 132 0.025 inches and from the top of the lip 132 another 0.025 inches to provide a surface 0.025 inches high to engage the edge of the top spring part 110 when it rests on the lip 132 and yet enable spacing to be maintained with the bottom wall 60 of the case 50.

With this arrangement, the top spring part 110, when the battery 36 is open circuited, is substantially parallel to the bottom wall 60 of the case 50 and held in this position by the lip 132 while the ridge 130 rests against the casing and has a surface substantially parallel to the spring to provide stability. As the spacer arm 124 is moved, an edge of the guide member 120 engages the wall 62B to maintain alignment and prevent the spacer arm 124 from tilting the board 30.

To provide an adequate lip surface and ridge surface, the combined lip 132 and ridge 130 is 0.125 inches in width and the ridge 130 has a width of 0.062 inches and a length of 0.187 inches, with the combined length of the force surface 122 and guide member 120 being 0.5 inches and the distance from the force surface 122 to the edge of the ridge 130 that engages the top spring part 110 having a length of 0.328 inches. With this arrangement, both the guide member 120 and the spacer arm 124 slide on guide surfaces spaced apart by the height of the ridge 130 so that the ridge 130 is sliding upon the bottom wall 60 of the case 50 and the guide member 120 is sliding against the top surface of the guide ledge 66B.

Figure 11:
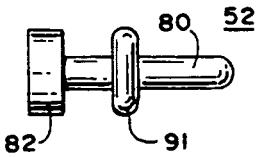
FIG. 11 is an enlarged side elevational view of still another portion of the embodiment of FIG. 1.
Figure 12:
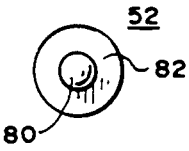
FIG. 12 is an enlarged end view of the portion of FIG. 11.

In FIGS. 11 and 12, there is shown an enlarged side elevational view and an enlarged front elevational view respectively of the pin or plunger 52 more clearly showing the shaft 80 and the head 82. The shaft 80 is 0.28 inches long and a diameter of 0.05 inches so that the shaft 80 fits closely and is guided within the passageway 74 (FIG. 1) having the same diameter and is sufficiently long to extend out of the end of the boss 70 (FIG. 1) and move the positive contact spacer 102 a distance sufficient to move the spacer lip 138 (FIG. 9) from under the top spring member 110 (FIG. 7) to close the battery circuit and energize the transmitter. Thus, it must extend out of the end of the passageway 74 a distance of at least 0.125 inches in the preferred embodiment.

To close the opening 72 to the passageway 74, the head 82 must be sufficiently large and deep to fit within a recess to form a smooth surface. In the preferred embodiment, it has a diameter of 0.134 inches and a depth of 0.050 inches to conform to the opening 72 in depth and diameter.

Figure 13:
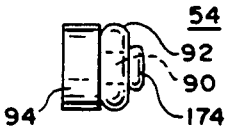
FIG. 13 is an enlarged side elevational view of still another portion of the embodiment of FIG. 1.

In FIG. 13, there is shown an enlarged sectional view of the plug 54 illustrating the shaft 90, the O-ring 92 and the head 94. The head 94 has a diameter of 0.134 inches to close the opening 72 after the battery circuit has been closed. The shaft 90 holds an O-ring 92 that is slightly larger to fit within the recess just before the passageway 74 with a watertight seal and is held in place by a retainer ring 174 having an outer diameter of 0.062 inches. The entire longitudinal length along the axis passing through the center of the head 94, the shaft 90 and the retainer ring 174 is 0.137 inches so that it fits within the recess with the outer surface flat.

In fabricating the transmitter with the battery conservation circuit, the circuit boards are first prepared in the "cracker board" mode in which a number of boards are separated on a single substrate by weakened portions cut with precision so that the precision of the boards are at least plus or minus 0.007 inches. The holes are similarly drilled with precision including a hole which receives a portion of a battery having a cylindrical shoulder to hold the battery so it slightly protrudes from one end.

The components are located in place and a dummy battery of the same dimensions is located as well as two conductive springs that hold the dummy battery in place. The springs and components are then soldered but the springs are flexible enough so the dummy battery can then be removed and an actual battery located in place.

At least one of the springs exerts enough force against a side of the battery to hold it tightly in place in the circuit board and both conductive springs have sufficient force to establish an electrical contact.

An opening is provided in the casing to insert a member for closing a battery circuit. A slide having at least two surfaces that cooperate with guide surfaces in the case includes a spacer member that fits between the battery and one of the springs along an edge. It overlaps in two directions, one parallel to the edge and the other perpendicular so that movement in a perpendicular direction removes the spacer member to close the contact against the battery and thus energize the circuit. The spacer member must be sufficiently thick to break electrical contact, sufficiently thin to not impress a permanent strain on the spring and have a length in the direction of movement that is at least 0.01 inches but less than 0.5 inches and the member which slides must have sufficient room to slide to remove the spacer member.

To energize the battery, a pin assembly 52 is provided in the preferred embodiment which passes through the casing and moves the slidable contact spacer 102 a sufficient distance to remove the spacer arm 124 and cause battery contact to be made. To avoid entrance of moisture, a second plug with an O-ring is inserted in the opening after the pin is fully depressed.

With this arrangement, the transmitter may be assembled and stored without draining the battery and the battery enabled just prior to the actual incorporation into use of the circuit. Consequently, the circuits may be produced in larger quantities rather than being produced to satisfy an immediate need and yet will not have their life shortened by storage of an energized battery operated device. This ability permits the entire device to be encased in a water tight container or be constructed in such a manner that the entire unit is disposable rather than being a unit in which the battery must be replaced.

In operation, a permanent wrist band is placed on personnel to be monitored. Just before locating the band on the patient, a pin is depressed through a fixed location on the sealed casing. The pin moves a predetermined distance against a relatively large force surface of the spacer. The spacer is moved along a guideway with minimum tilting, thus moving a spacer arm a short distance from a fixed edge to permit the spring to drop downwardly against the battery and energize the circuit.

To permit sufficient precision to avoid misalignment, the circuit board is made from precision materials cut to accurate dimensions to prepare a series of boards and the holes are drilled with a tolerance of plus or minus 0.007 inch. Of particular significance is the battery location on the board which fixes the battery with respect to the guideway molded into the casing and to a guiding aperture which receives the plunger to be inserted through the casing.

To permit soldering of electrical components, the leaf springs are placed in apertures in the board and a dummy battery located between them. A continuous soldering method is then used to solder the components and the battery springs in place prior to assembling into the casing.

Accordingly, the battery protection circuit of this invention has several advantages such as: (1) it is inexpensive; (2) it is not subject to shorting out during use of the transmitter; and (3) it may be maintained in a water tight casing.

Although a preferred embodiment of the invention has been described with some particularity, many modifications and variations of the preferred embodiment may be made without deviating from the invention. Therefore, it is to be understood that, within the scope of the appended claims, the invention may be practiced other than as specifically described.

What is claimed is:

1. Electronic apparatus adapted to withstand moisture conditions and adapted to contain a battery for power, comprising:

a watertight casing;

a battery;

closable switch means for closing a circuit means including electrical circuitry connected to said battery, whereby said electrical circuitry may be energized by said battery upon closing of said closable switch means; and means for causing closing of said closable switch means to apply energy from said battery to said circuit means without permanently permitting the entrance of moisture within said casing;

said closable switch means including at least one movable electrical contact and one insertable member;

said insertable member including means for causing said movable electrical contact to move at least in one of two directions; wherein motion in said one of said two directions closes said switch and the other opens said switch.

2. Apparatus according to claim 1 in which said switch means comprises a flexible conductor biased to contact said battery and said insertable member includes a means for spacing said flexible conductor from said battery and means for removing said means for spacing whereby said flexible conductor contacts said battery.

3. Apparatus according to claim 2 in which said means for spacing fits between said flexible conductor and said battery and the means for spacing said flexible conductor overlaps within a range of 0.1 inches and 0.25 inches in the direction of motion of said means for spacing.

4. Apparatus according to claim 1 in which said closable switch means comprises a reed switch and said means for causing activation comprises a ferromagnetic member.

5. A method of energizing a battery within a casing comprising the steps of:

inserting a pin into the casing and moving a spacer positioned between a flexible conductor and a battery terminal, whereby said spacer is removed to cause said flexible conductor to contact said battery terminal;

and inserting an additional sealing member, whereby said casing is rendered watertight.

* * * * *